US006085646A

United States Patent [19]

Lauterbach et al.

[11] Patent Number: 6,085,646

[45] Date of Patent: Jul. 11, 2000

[54] MULTIPLE NIP CALENDER FOR A PAPER MAKING MACHINE

[75] Inventors: Richard J. Lauterbach, Hattiesburg, Miss.; Richard J. Santkuyl, Menasha, Wis.

[73] Assignee: Beloit Technologies, Inc., Wilmington, Del.

[21] Appl. No.: 09/128,486

[22] Filed: Aug. 4, 1998

[51] Int. Cl.[7] ..... D21G 1/00; B30B 3/04

[52] U.S. Cl. ..... 100/163 R; 100/170; 100/173; 100/331

[58] Field of Search ..... 100/161, 162 R, 100/163 R, 163 A, 166, 168–170, 173, 331; 162/360.2, 360.3

[56] References Cited

U.S. PATENT DOCUMENTS

| | | | |
|---|---|---|---|
| 3,089,460 | 5/1963 | Mahoney et al. . | |
| 3,124,480 | 3/1964 | Mahoney et al. . | |
| 3,124,481 | 3/1964 | Mahoney . | |
| 3,124,504 | 3/1964 | Mahoney et al. . | |
| 3,254,593 | 6/1966 | Beachler | 100/162 R |
| 3,270,664 | 9/1966 | Veneman et al. | 100/162 R |
| 3,451,331 | 6/1969 | Fredrickson et al. . | |
| 3,720,160 | 3/1973 | Kraft et al. | 100/161 |
| 3,905,288 | 9/1975 | Holm | 100/162 R |
| 4,080,890 | 3/1978 | Dreher . | |
| 4,131,063 | 12/1978 | Joutsjoki | 100/162 R |
| 4,211,165 | 7/1980 | Schill | 100/162 R |
| 4,492,612 | 1/1985 | Matarainen . | |
| 4,510,859 | 4/1985 | Berry . | |
| 4,624,744 | 11/1986 | Vreeland . | |
| 4,790,908 | 12/1988 | Roerig et al. . | |
| 4,823,688 | 4/1989 | Wedel et al. . | |
| 4,874,469 | 10/1989 | Pulkowski et al. . | |
| 4,915,026 | 4/1990 | Halme . | |
| 5,033,373 | 7/1991 | Brendel et al. . | |
| 5,077,095 | 12/1991 | Alheid . | |
| 5,167,768 | 12/1992 | Cronin et al. . | |
| 5,251,551 | 10/1993 | Abe et al. . | |
| 5,400,707 | 3/1995 | Neider et al. . | |
| 5,524,532 | 6/1996 | Koivukunnas et al. . | |
| 5,590,593 | 1/1997 | Korhonen et al. . | |

*Primary Examiner*—Stephen F. Gerrity
*Attorney, Agent, or Firm*—Michael Best & Friedrich LLP

[57] ABSTRACT

A four nip calender apparatus mounted on a single frame. The apparatus includes a first vertical calender mounted on the frame wherein the web passes through a first nip formed by a first calender roll and a second calender roll. The apparatus also includes a horizontal calender configuration providing two nips. The horizontal, three-roll arrangement is mounted on the frame and has a center roll and a pair of rolls positioned on opposite sides of the center roll which, with the center roll, provide the second and third nips. The apparatus also includes a fourth nip provided by a second vertical calender mounted on the frame.

27 Claims, 2 Drawing Sheets

MULTIPLE NIP CALENDER FOR A PAPER MAKING MACHINE

BACKGROUND OF THE INVENTION

1. Technical Field

The invention relates generally to apparatus for calendering a traveling web, such as a web of paper, and more particularly to apparatus and methods for supporting multiple calender rolls on a paper making machine.

2. Related Prior Art

It is generally known to treat a travelling web, such as a web of paper or paper board, by means of calendering to provide desirable surface properties. For example, the smoothness and degree of gloss provided by the web's surfaces can be varied by calendering.

Many grades of paper and paper board need to be calendered on both sides of the web so as to achieve the desired high quality finishes of those surfaces. To provide such finishing, it is generally known to pass the web through a first nip provided by a first calender assembly to treat one side of the web and through a second nip provided by a second calender assembly to treat the second side of the web. Moreover, many grades of paper need multiple passes through calender nips on each side of the web to achieve the desired finish characteristics. To achieve such finishing, it is known to provide multiple calendering apparatus arranged in either a vertical configuration or a horizontal configuration.

A vertical calender provides a pair of calender rolls mounted for rotation about respective axes which lie in a substantially vertical plane. In general, such vertical calenders provide finishing apparatus having a relatively high machine efficiency and better control of finish on the web. Machine efficiency is improved because the web follows a relatively horizontal straight path through the nip, thus making threading of the web along the machine easier and facilitating control of tension on the web. Also, machine efficiency is enhanced by the relatively short amount of space in the machine direction required for a single pair of vertically arranged calender rolls. In addition, should the web break, vertical calender arrangements are somewhat easier to clear of broke.

In applications wherein multiple calender passes are necessary, passing a web through a series of vertical calenders to alternatingly treat the opposite sides of the web increases control over the finish on the opposed sides of the web. Also, the rolls in each successive calender can be individually controlled to provide the appropriate web surface treatment.

A horizontal calender provides a pair of calendering rolls mounted for rotation on respective axes lying in a generally horizontal plane. Such a horizontal configuration often includes a third roller mounted for rotation in the common horizontal plane such that the web travels vertically between a first nip formed by the first and second rolls and subsequently through a second nip formed by the second and third rolls. In soft calendering, such a horizontal arrangement provides two nips which treat a single side of the web. Thus, for providing two nips, a horizontal calender entails a relatively low capital cost and requires less space in the machine direction when compared to a vertical single nip arrangement. The capital cost is relatively low for a three-roll horizontal calender because two nips can be formed using only three rolls compared to four rolls if vertical calenders are used. Also, a horizontal calender provides a finish treating apparatus that is somewhat easier to control than a vertical calender because the nip pressure applied to the web can be controlled by adjusting the spacing between the calender rolls through horizontal movements that need not overcome the weight of the calender rolls, i.e., the calender rolls need not be lifted into or out of engagement with the web. As a result, nip pressure adjusting apparatus associated with a horizontal calender need not be as powerful as the apparatus needed to adjust a comparable vertical calender assembly.

SUMMARY OF THE INVENTION

Because machine efficiency relates to maintaining integrity of the web, tension control on the web and machine maintenance and/or roll change time, there are respective advantages realized in using vertical calender configurations and horizontal calender configurations. The utilization of each configuration also entails disadvantages. In general, vertical calender configurations provide a relatively uncomplicated sheet run while maintaining a sufficient degree of wrap about tension control devices and sufficiently long runs to adequately provide room for spreading of the web. Also, the mounting configurations of a vertical calender arrangement provides relatively easy access to the rolls for maintenance and roll changing.

With respect to horizontal calender configurations providing multiple nips, the path of the web is somewhat tortuous and treatment of the web with a horizontal configuration entails treatment of the web through two nips before the other side of the web can be treated. This makes it difficult to achieve the same or comparable finish on both sides of the web because of moisture loss that occurs in the first nip makes treatment by subsequent or later nips less responsive. As a result, alternate treatment of a web's opposite sides with a vertical calender configuration is sometimes preferable. However, providing successive vertical calendering rolls requires relatively more space between the nips in the machine direction. This drawback can be a significantly limiting factor in retrofitting a paper making machine with upgraded web treating apparatus, such as on-machine calendering apparatus, because the existing machine length may limit the machine direction distance or space available for multiple calenders.

The invention provides a four nip calender apparatus wherein the entire calendering apparatus is mounted on a single frame. The arrangement of calender rolls provides the advantages of a combination of vertical and horizontal nips and requires less space in the machine direction than otherwise would be achievable. This benefit of a multiple nip calendering arrangement in a relatively short amount of space in the machine direction affords use of this arrangement in machine rebuild applications or retro-fitting applications where machine direction space may be limited.

The invention thus provides an apparatus for treating a web including a combination of vertical and horizontal calenders mounted on a single frame in a configuration that achieves a high degree of machine efficiency and that permits treatment of opposite sides of the web in an alternating manner.

More particularly, the apparatus provides a four nip calender apparatus mounted on a single frame. The apparatus includes a first vertical calender mounted on the frame wherein the web passes through a first nip formed by a first calender roll and a second calender roll. The web passes by tension control and spreading rolls which are also mounted on the frame before entering a horizontal calender configuration providing two nips. The horizontal, three-roll arrangement is mounted on the frame and has a center roll and a pair of rolls positioned on opposite sides of the center roll and, with the center roll, providing the second and third nips. The web again passes through tension control and spreader rolls mounted on the frame before passing through a fourth nip provided by a second vertical calender mounted on the frame.

In one embodiment, the invention provides apparatus for treating a travelling web having a frame and a first vertical calender assembly. The first vertical calender includes a first pair of calender rolls supported by the frame for rotation about respective axes, the first pair of rolls being arranged to provide a first (vertical) nip through which the web is adapted to pass to apply nip pressure on the web. The first vertical calender assembly includes means for adjusting the position of one roll of the first pair of vertical calender rolls to control the nip pressure applied to the web.

The apparatus also includes a horizontal calender assembly having a set of three calender rolls supported by the frame. The set of three calender rolls includes a first roll and a second roll arranged to define a second (horizontal) nip through which the web is adapted to pass to apply a nip pressure to the web. A third roll is arranged with the roll to define a third (horizontal) nip through which the web is adapted to pass to apply a nip pressure to the web. The horizontal calender assembly also has means for moving one of the first and second rolls relative to the other roll and means for moving one of the second and third rolls relative to the other roll.

The apparatus also has a second vertical calender assembly including a second pair of calender rolls supported by the frame for rotation about respective axes. The second pair of rolls are arranged to provide a fourth (vertical) nip through which the web is adapted to pass to apply nip pressure on the web. The second vertical calender assembly includes means for adjusting the position of one roll of the second pair of vertical calender rolls to control the nip pressure applied to the web.

Other features and advantages of the invention will become apparent to those skilled in the art upon review of the following detailed description, claims and drawings.

Figure 1:
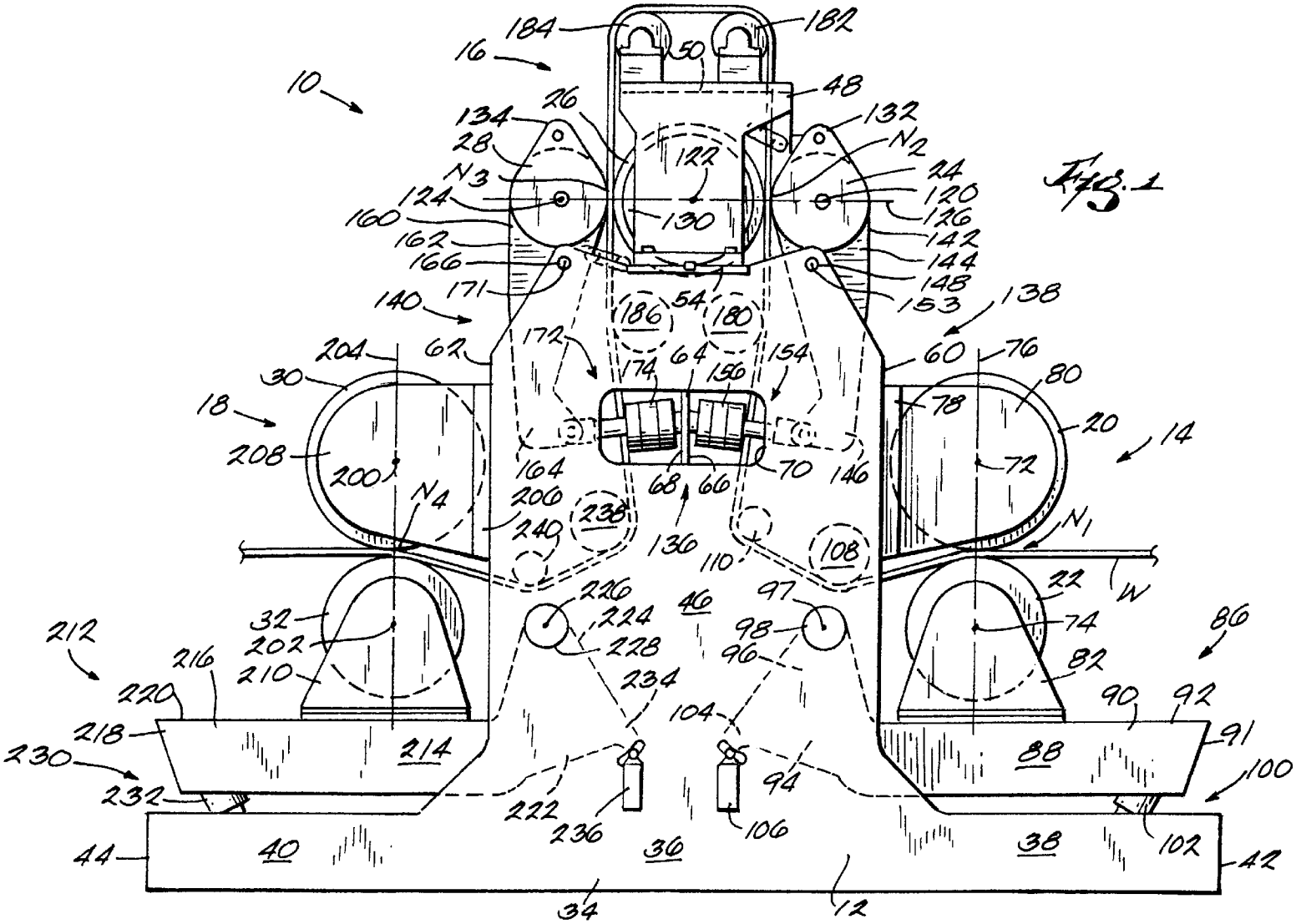
FIG. 1 is a side elevation view of an apparatus embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

FIG. 1 illustrates apparatus 10 in the form of a paper making machine for processing and treating a travelling web W made of paper or paper board. For the purposes of discussion, the direction of travel of the web W is in the "machine direction" from right to left in the drawings, and the "cross machine direction" will be considered to be in and out of the page.

The apparatus 10 is operable for calendering the web W by sequentially passing the web W through multiple nips respectively provided by multiple sets of calender rolls, all of which are supported on a single frame 12. FIG. 1 illustrates one side of the frame 12, and the frame 12 has an opposite side which is the mirror image to that illustrated in FIG. 1. The frame 12 has a length extending in the cross-machine direction sufficiently long to support rolls for treating the entire width of the web W.

In general, the frame 12 supports a first vertical calender assembly 14 providing a first nip $N_1$, a horizontal calender assembly 16 providing a second nip $N_2$ and third nip $N_3$ and a second vertical calender assembly 18 providing a fourth nip $N_4$. The first vertical calender assembly 14 includes first and second calender rolls 20, 22 defining therebetween the first nip $N_1$; the horizontal calender assembly 16 includes a set of three calender rolls 24, 26, 28, the first and second of which 24, 26 define the second nip $N_2$ and the second and third of which 26, 28 define the third nip $N_3$; and the second vertical calender assembly 18 includes a pair of rolls 30, 32 defining the fourth nip $N_4$. The web W passes sequentially through the nips $N_1$, $N_2$, $N_3$ and $N_4$, each of which apply a nip pressure to the web W. Thus the apparatus 10 provides a total of seven calender rolls 20, 22, 24, 26, 28, 30 and 32 which are arranged to define four nips $N_1$, $N_2$, $N_3$ and $N_4$ and which are supported on the single frame 12. The arrangement of the vertical calender assemblies 14, 18 and the horizontal calender assembly 16 on the single frame 12 is discussed in more detail below.

The frame 12 provides a unitary supporting structure for the vertical calender assemblies 14, 18 and the horizontal calender assembly 16. The frame 12 is preferably formed as a one-piece structure. However, those of skill in the art will readily recognize that various configurations of components can be rigidly interconnected to successfully provide the frame 12. More particularly, the frame 12 includes a base 34 having a central portion 36 and a pair of feet 38, 40 respectively extending upstream and downstream with respect to the machine direction from the central portion 36 to respective opposite ends 42, 44.

The frame 12 also includes a stanchion 46 extending upwardly from the central portion 36 of the base 34 to an upper end 48. The frame 12 also includes an upper platform 50 which is supported by the upper end 48 of the stanchion 46. The stanchion 46 also supports an intermediate platform 54 which is located between the upper platform 50 and the base 34 of the frame 12.

In order to support portions of the vertical calender assemblies 14, 18, the stanchion 46 also defines a first bracket mounting surface 60 and a second bracket mounting surface 62. The first bracket mounting surface 60 is generally vertical and faces upstream with respect to the direction of travel of the web W. The second bracket mounting surface 62 also extends generally vertically and faces opposite of the first bracket mounting surface 60, i.e., downstream with respect to the direction of travel of the web W. The first and second bracket mounting surfaces 60, 62 are located below the intermediate platform 54 and are respectively located above the upstream foot 38 and downstream foot 40 of the base 34.

In order to provide thrust surfaces against which actuators associated with the horizontal calender 16 can act, the frame 12 also includes a thrust plate 64 which is fixed to and which extends in the cross-machine direction from the stanchion 46. The thrust plate 64 is located above the base 34 centrally between the opposite ends 42, 44 of the base 34 and is generally below the intermediate platform 54. The thrust plate 64 provides a pair of generally vertical opposite surfaces 66, 68 respective facing upstream and downstream in the machine direction.

In order to provide access to the horizontal calender assembly 16 for maintenance, machine set-up, removal of broke, etc., the stanchion 46 has extending therethrough an opening 70 in the cross-machine direction for providing access through the stanchion 46 to the thrust plate 64 and otherwise to the interior of the apparatus 10. The opening 70 is located below the intermediate platform 54 and above the central portion 36 of the base 34.

The frame 12 supports the first vertical calender assembly 14 such that the first nip $N_1$ is the most upstream nip with respect to the direction of travel of the web. The first pair of calender rolls 20, 22 are supported by the frame 12 for rotation about respective axes 72, 74 lying in a common vertical plane 76. The first roll 20 is shown in the drawings as a "hot" roll which is fixed in a stationary position on the frame 12. The vertical calender assembly 14 also includes a first roll mounting bracket 78 fixed to the frame 12 at the first bracket mounting surface 60 and a first roll bearing housing 80. The bracket 78 and bearing housing 80 support the first roll 20 in a stationary position for rotation about its axis 72.

The second roll 22 is mounted on the frame 12 for selective movement relative to the frame 12 and to the first roll 20. The second roll 22 of the first pair of calender rolls is shown in the drawings as a "cold" roll, and is supported by a respective bearing housing 82 for rotation about axis 74 located below the axis 72 of the first roll 20 so as to define the plane 76.

The frame 12 also includes means 86 for adjusting the position of the second roll 22 of said first pair of calender rolls to control the linear pressure applied to the web W at the first nip $N_1$. While various suitable constructions could be used, in the illustrated embodiment such adjusting means 86 includes a first movable carriage 88 which is mounted on the frame 12 for pivotable movement relative to the frame 12 and which carries the second roll 22 of the first pair of calender rolls.

More particularly, the carriage 88 includes a bearing housing support arm 90 having an end 91 that extends generally horizontally over the upstream foot 38 of the base 34 and under the first roll bearing housing 80. The bearing housing support arm 90 also provides a bracket mounting surface 92 to which the second roll bearing housing 82 supporting the second roll 22 of the first pair of vertical calender rolls is fixed.

The first carriage 88 also includes a pivot arm 94 that extends from the bracket support arm 90 generally downstream to a pivot end 96 that is located inwardly of the stanchion 46. The first carriage 88 is pivotally mounted on the frame 12 for movement relative to the frame 12 about a pivot axis 97 by means of a pivot joint 98 that connects the pivot end 96 of the pivot arm 94 to the frame 12. The pivot joint 98 affords pivoting movement of the first carriage 88 between an engaged position (shown in FIG. 1) wherein the second calender roll 22 contacts the web W and compresses the web W between the first and second calender rolls 20, 22 and a disengaged position (not shown) wherein the second calender roll 22 is moved away from the first calender roll 20 so as to provide clearance therebetween.

The means 86 for adjusting the position of the second roll 22 of the first pair of calender rolls also includes biasing means 100 for pivoting the first carriage 88 about the pivot axis 97 between the engaged and disengaged positions. While various suitable arrangements could be used, in the illustrated embodiment, such biasing means 100 includes a loading cylinder 102, such as an air spring, that is attached to the upstream or free end 91 of the bearing housing support arm 90. The loading cylinder 102 is operable to lift the bearing housing support arm 90 and the second roll 22 supported thereby into the engaged position by pivoting the first carriage 88 relative to the frame 12 and to the first roll 20 about the pivot axis 97 to adjust the linear load applied to the web W at the first nip $N_1$.

The first carriage 88 also includes an extension 104 on the pivot arm 94 which is engageable with an unloading cylinder 106 mounted on the frame 12. When in the engaged position, the extension 104 contacts the unloading cylinder 106. The unloading cylinder 106 is operable to lift the extension 104 to quickly move the bearing housing support arm 90 to the disengaged position. Thus, the unloading cylinder 106 prevents the "hot" first roll 20 from contacting and damaging the "cold" second roll 22 if, for example, the web W breaks.

The first vertical calender assembly 14 also includes a tension control roll 108 mounted on the frame 12 downstream of the first nip $N_1$ and a spreading roll 110 mounted on the frame 12 and located downstream of the tension control roll 108. The tension control roll 108 and spreading roll 110 are supported by the frame 12 in a conventional manner.

The frame 12 supports the set of three calender rolls 24, 26, 28 of the horizonal calender assembly 16 in an elevated position generally above and downstream of the first vertical calender assembly 14. More particularly, the set of rolls 24, 26, 28 is supported by the frame 12 for rotation about respective axes of rotation 120, 122, 124 which lie in a common horizontal plane 126. The frame 12 supports the horizontal calender assembly 16 such that the second nip $N_2$ is upstream of the third nip $N_3$ with respect to the direction of travel of the web.

With reference to FIG. 1, the set of three rolls 24, 26, 28 included in the horizontal calender assembly 16 are supported by the frame 12 in the following manner: the center roll 26 is shown in the drawings as a "hot" roll which is fixed in a stationary position on the intermediate platform 54. The horizontal calender assembly 16 also includes a mounting bracket and bearing housing 130 fixed to the intermediate platform 54 to support the center roll 26 on the frame 12.

The second and third horizontal calender rolls 24, 28, shown in the drawings as "cold" rolls, are supported on the frame 12 for movement relative thereto. The second or forward horizontal calender roll 24 is supported by a bracket and bearing housing 132 for rotation about axis 120 located upstream of the axis 122 of rotation of the center roll 26 so as to lie in the horizontal plane 126. The third or rearward calender roll 28 is also supported by a bracket and bearing housing 134 for rotation about axis 124 which is located downstream of the axis 122 of rotation of the center roll 26 and which lies in the horizontal plane 126.

The horizontal calender assembly 16 also includes means 136 for supporting the second and third horizontal calender rolls 24, 28 for movement relative to the center calender roll 26. While various suitable arrangements could be used, in the illustrated embodiment, the support means 136 includes means 138 for adjusting the position of the forward roll 24 of the set of three rolls relative to the center roll 26 to control the nip pressure applied to the web W at the second nip $N_2$.

The support means 136 also includes means 140 for adjusting the position of the rearward roll 28 relative to the center roll 26 to control the nip pressure applied to the web W at the third nip $N_3$.

While various suitable arrangements can be successfully used, in the illustrated embodiment, the means 138 for adjusting the position of the forward roll 24 includes a second movable carriage 142 that is pivotably mounted on the frame 12 for movement relative thereto and that supports the forward calender roll 24. The second carriage 142 is mounted on the intermediate platform 54 and extends generally vertically. The second carriage 142 has opposite arms 144, 146 extending from a pivot joint 148 about which the second carriage 142 can be pivoted. The first, upper arm 144 supports the bracket and bearing housing 132 and the forward roll 24. The second, lower arm 146 of the second carriage 142 extends downwardly to an end located proximate the upstream face 66 of the thrust plate 64. The pivot joint 148 is located intermediate the arms 144, 146 of the second carriage 142 and supports the second carriage 142 for movement relative to the frame 12 about a pivot axis 153. The pivot joint 148 affords pivoting movement of the second carriage 142 between an engaged position (shown in FIG. 1) wherein the forward calender roll 24 contacts the web W and compresses the web W between the forward and center calender rolls at 24, 26 the second nip $N_2$ and a disengaged (not shown) position wherein the forward calender roll 24 is moved away upstream from the center calender roll 26 so as to provide clearance therebetween.

The means 138 for adjusting the position of the forward roll 24 of the horizontal calender assembly 16 also includes means 154 for pivoting the second carriage 142 about its pivot axis 153 between the engaged and disengaged positions. While various suitable arrangements could be used, in the illustrated embodiment, such means 154 includes a loading cylinder 156, such as an air spring, that is attached to the end of the lower arm 146 of the second carriage 142. The loading cylinder 156 is also operably fixed to the thrust plate 64. The loading cylinder 156 is operable to pivot the upper arm 144 of the second carriage 142 and the forward roll 24 supported thereby between the disengaged position and the engaged position, and to adjust the linear load applied to the web W in the second nip $N_2$, by pivoting the second carriage 142 relative to the frame 12 and the center roll 26 about the pivot axis 153.

The second carriage 142 also includes an unloading cylinder (not shown) mounted on the frame 12. The unloading cylinder is operable to quickly move the upper arm 144 and the second roll 24 to the disengaged position. Thus, the unloading cylinder prevents the "hot" center roll 26 from contacting and damaging the "cold" second roll 24 if, for example, the web W breaks.

The means 140 for adjusting the position of the third or rearward roll 28 relative to the center roll 26 includes a third carriage 160 that is also mounted on the intermediate platform 54 and extends generally vertically. The third carriage 160 is similar to the second carriage 142, and has opposite arms 162, 164 extending from a pivot joint 166 about which the third carriage 160 can be pivoted. The first, upper arm 162 supports the bearing housing and bracket 134 which, in turn, supports the rearward roll 28. The lower arm 164 of the third carriage 160 extends downwardly to an end located proximate the downstream face 68 of the thrust plate 64. The pivot joint 166 is located intermediate the ends 162, 164 of the third carriage 160 and supports the third carriage 160 for movement relative to the frame 12 about a pivot axis 171. The pivot joint 166 affords pivoting movement of the third carriage 160 between an engaged position wherein the rearward calender roll 28 contacts the web W and compresses the web W between the rearward and center calender rolls 26, 28 at the third nip $N_3$ and a disengaged position wherein the rearward roll 28 is moved downstream from the center roll 26 so as to provide clearance therebetween.

The means 140 for adjusting the position of the rearward roll 28 of the horizontal calender assembly 16 also includes means 172 for pivoting the third carriage 160 about its pivot axis 171 between the engaged and disengaged positions. While various suitable arrangements could be used, in the illustrated embodiment, such means 172 includes a loading cylinder 174, such as an air spring, that is attached to the lower end of the third carriage 160. The loading cylinder 174 is also operably fixed to the downstream face 68 of the thrust plate 64. The loading cylinder 174 is operable to pivot the upper arm 162 of the third carriage 160 and the rearward roll 28 supported thereby between the disengaged position and the engaged position, and to adjust the linear load applied to the web W in the third nip $N_3$, by pivoting the third carriage 160 relative to the frame 12 and the center roll about the pivot axis 171.

The third carriage 160 also includes an unloading cylinder (not shown) mounted on the frame 12. The unloading cylinder is operable to quickly move the upper arm 162 and the third roll 28 to the disengaged position. Thus, the unloading cylinder prevents the "hot" center roll 26 from contacting and damaging the "cold" third roll 28 if, for example, the web W breaks.

The horizontal calender assembly 16 also includes a plurality of tension control rolls mounted upstream and downstream of the second and third nips $N_2$ and $N_3$. The tension control rolls are supported by the frame 12 in a conventional manner. More particularly, the horizontal calender assembly 16 includes a first tension control roll 180 mounted on the frame 12 upstream of the second nip $N_2$, a second tension control roll 182 mounted on the upper platform 50 above the second nip $N_2$ and a third tension control roll 184 mounted on the upper platform 50 in a position immediately downstream the second tension control roll 183 and above the third nip $N_3$. The horizontal calender assembly 16 also includes a fourth tension control roll 186 mounted on the frame 12 immediately below the third nip $N_3$.

The frame 12 supports the second vertical calender assembly 18 such that the fourth nip $N_4$ is the most downstream nip provided by the apparatus 10. The second vertical calender assembly 18 is similar in arrangement and operation to the first vertical calender assembly 14. More particularly, the second vertical calender assembly 18 includes the pair of calender rolls 30, 32 supported by the frame 12 for rotation about respective axes 200, 202 lying in a common vertical plane 204. The pair of calender rolls includes the first roll 30 which is shown in the drawings as a "hot" roll and which is fixed in a stationary position on the frame 12. The second vertical calender assembly 18 also includes a first roll mounting bracket 206 fixed to the frame 12 at the second bracket mounting surface 62 and a bearing housing 208. The bracket and bearing housing 206, 208 support the first roll 30 of the second vertical calender 18 for rotation about axis 200.

The second pair of vertical calender rolls also includes the second roll 32 which is mounted on the frame 12 for selective movement relative to the frame 12 and to the first roll 30. The second roll 32, shown in the drawings as a "cold" roll, is supported by a respective bearing housing 210 for rotation about axis 202 located below the axis 200 of rotation of the first roll 30 so as to define the plane 204.

The apparatus 10 also includes means 212 for adjusting the position of the second roll 32 of the second vertical calender rolls to control the nip pressure applied to the web W at the fourth nip $N_4$. While various suitable constructions could be used, in the illustrated embodiment such means 212 includes a fourth movable carriage 214 which is mounted on the frame 12 for pivotable movement relative to the frame 12 and which carries the second roll 32 of the second pair of calender rolls. More particularly, the fourth carriage 214 includes a bearing housing support arm 216 having an end 218 that extends over the downstream foot 40 of the base 34 and under the bearing housing 208 supporting the first roll 30 of the second pair of vertical calender rolls. The bearing housing support arm 216 also provides a bracket mounting surface 220 to which the bearing housing 210 supporting the second roll 32 is fixed.

Figure 2:
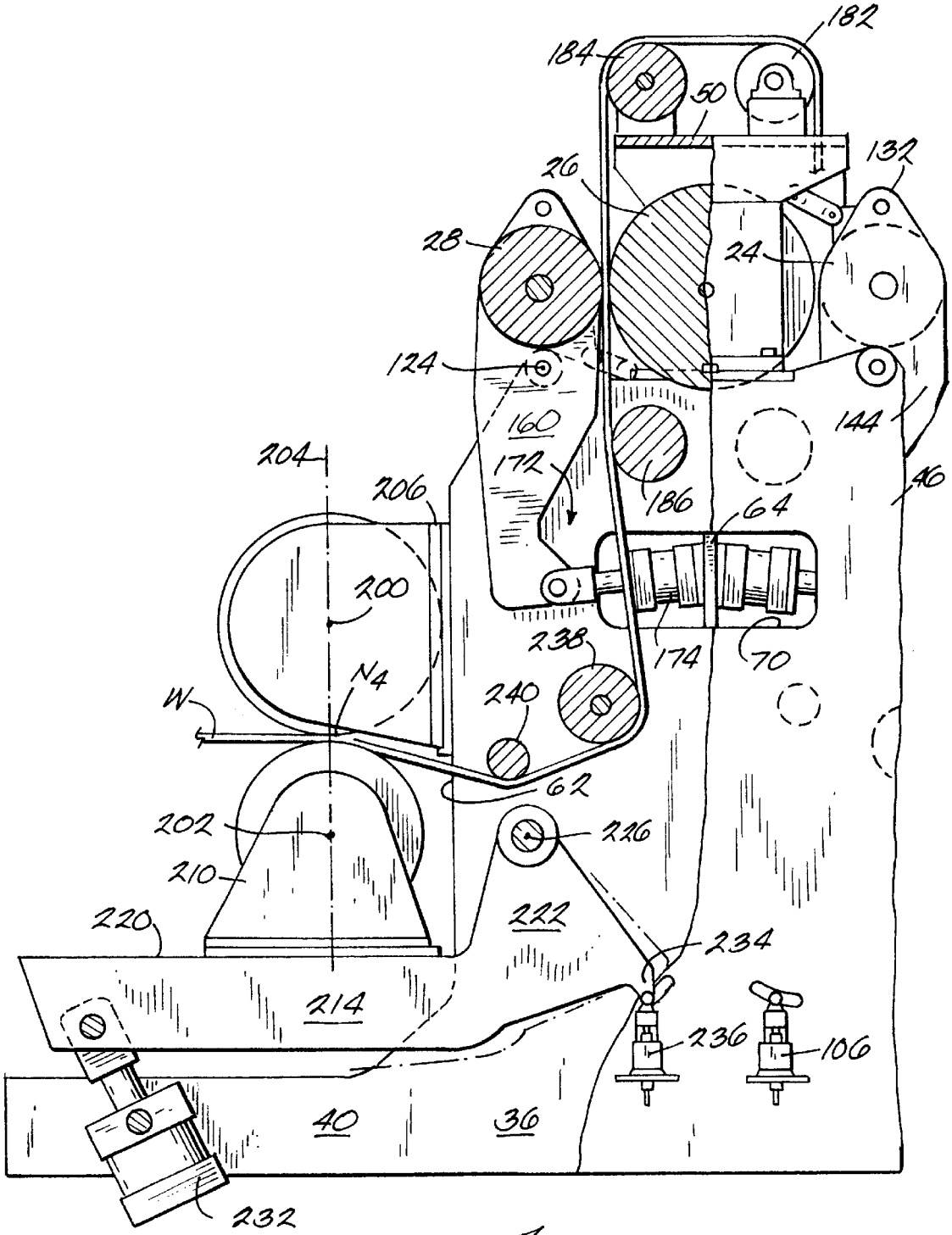
FIG. 2 is an enlarged view of a portion of the apparatus illustrated in FIG. 1.

The fourth carriage 214 also includes a pivot arm 222 that extends from the bearing housing support arm 216 generally upstream to a pivot end 224 that is located inwardly of the stanchion 46. The fourth carriage 214 is pivotally mounted on the frame 12 for movement relative thereto about a pivot axis 226 by means of a pivot joint 228 that connects the pivot end 224 of the pivot arm 222 to the frame 12. The pivot joint 228 affords pivoting movement of the fourth carriage 214 between an engaged position (shown in FIG. 2) wherein the second roll 32 contacts the web W and compresses the web W between the first and second calender rolls 30, 32 and a disengaged position (shown in phantom in FIG. 2) wherein the second roll 32 is moved away from the first roll 30 so as to provide clearance therebetween.

The means 212 for adjusting the position of the second roll 32 of the second pair of vertical calender rolls also includes means 230 for pivoting the fourth carriage 214 about the pivot axis 226. While various suitable arrangements could be used, in the illustrated embodiment, such means 230 includes a loading cylinder 232, such as an air spring, that is attached to the downstream or free end 218 of the bearing housing support arm 216. The loading cylinder 232 is operable to lift the bearing housing support arm 216 and the second roll 32 supported thereby into the engaged position, and to adjust the linear load applied to the web W in the fourth nip $N_4$, by pivoting the fourth carriage 214 relative to the frame 12 and the first roll 30 about the pivot axis 226.

The fourth carriage 214 also includes an extension 234 on the pivot arm 222 which is engageable with an unloading cylinder 236 mounted on the frame 12. When in the engaged position, the extension 234 contacts the unloading cylinder 236. The unloading cylinder 236 is operable to lift the extension 234 to quickly move the bearing housing support arm 216 to the disengaged position. Thus, the unloading cylinder 236 prevents the "hot" first roll 30 from contacting and damaging the "cold" second roll 32 if, for example, the web W breaks.

The second vertical calender assembly 18 also includes a tension control roll 238 mounted upstream of the fourth nip $N_4$ and a spreading roll 240 mounted on the frame 12 and located upstream of the tension control roll 238. The tension control roll 238 and spreading roll 240 are also supported by the frame 12 in a conventional manner.

The apparatus 10 provides a four nip soft calender wherein the entire calendering apparatus is mounted on a single frame 12. The arrangement of calender rolls 20, 22, 24, 26, 28, 30 and 32 provides the advantages of a combination of vertical and horizontal nips and requires less space in the machine direction than otherwise would be achievable. This benefit of a multiple nip calendering arrangement in a relatively short amount of space in the machine direction affords use of this arrangement in machine rebuild applications or retrofitting applications where machine direction space may be limited.

The apparatus 10 also thus provides a combination of vertical and horizontal calenders 14, 16 and 18 mounted on the frame in a configuration that achieves a high degree of machine efficiency and that permits treatment of opposite sides of the web in an alternating manner. More particularly, the web W passes through the first nip $N_1$, by tension control and spreading rolls which are also mounted on the frame before entering a horizontal calender configuration which is supported by the common frame 12 and which provides nips $N_2$ and $N_3$ The web again passes through tension control rolls mounted on the frame before passing through the fourth nip $N_4$ provided by the second vertical calender 18, which is mounted on the frame 12.

Various features of the invention are set forth in the following claims.

We claim:

1. Apparatus for treating a travelling web, said apparatus comprising a frame;

a first vertical calender assembly including a first pair of calender rolls supported by said frame for rotation about respective axes, said first pair of rolls arranged to provide a first nip through which the web is adapted to pass to apply nip pressure on the web, said first vertical calender assembly including means for adjusting the position of one roll of said first pair of calender rolls to control the nip pressure applied to the web;

a horizontal calender assembly including a set of horizontal calender rolls supported by said frame and including a first roll and a second roll arranged to define a second nip through which the web is adapted to pass to apply a nip pressure to the web, wherein the web is adapted to pass through said second nip without substantially wrapping the horizontal calender rolls, said horizontal calender assembly including means for moving one of the first and second rolls relative to the other roll;

a second vertical calender assembly including a second pair of calender rolls supported by said frame for rotation about respective axes, said second pair of rolls arranged to provide a fourth nip through which the web is adapted to pass to apply nip pressure on the web, said second vertical calender assembly including means for adjusting the position of one roll of said second pair of calender rolls to control the nip pressure applied to the web; and wherein said calender assemblies are supported by said frame such that said rolls of said vertical calender assemblies are not supported by said rolls of said horizontal calender assembly.

2. Apparatus as set forth in claim 1 wherein said means for adjusting the position of the one roll of said first pair of rolls includes a first movable carriage that is mounted on said frame for pivotable movement relative to said frame and that carries said one roll of said first pair of calender rolls.

3. Apparatus as set forth in claim 2 and further including means for pivoting said first carriage.

4. Apparatus as set forth in claim 1 wherein said set of horizontal calender rolls includes three calender rolls, wherein said three calender rolls are supported by said frame for rotation about respective axes lying in a common plane.

5. Apparatus as set forth in claim 1 wherein said horizontal calender assembly includes a third roll defining, with one of the first and second rolls of said horizontal calender assembly, a third nip though which the web is adapted to pass to apply a nip pressure to the web.

6. Apparatus as set forth in claim 1 wherein said means for moving one of the rolls of the horizontal calender assembly includes a second movable carriage mounted on said frame for pivotable movement relative to said frame and carrying said one roll of the horizontal calender assembly.

7. Apparatus as set forth in claim 6 wherein said means for moving one of the rolls of the horizontal assembly includes means for pivoting the second carriage relative to the frame.

8. Apparatus as set forth in claim 6 wherein said horizontal assembly includes a third roll defining, with one of the first and second rolls of the horizontal calender assembly, a third nip, and furthering including means for moving said third roll relative to said one roll, said means for moving said third roll including a carriage supporting said third roll and being supported by said frame for pivotable movement relative to said frame.

9. Apparatus as set forth in claim 8 wherein said means for moving said third roll includes means for pivoting said carriage supporting said third roll.

10. Apparatus as set forth in claim 1 wherein said means for adjusting the position of the one roll of said second pair of rolls includes a movable carriage mounted on said frame for pivotable movement relative to said frame and carrying said one roll of said second pair of calender rolls and including means for pivoting said carriage.

11. Apparatus for treating a travelling web, said apparatus comprising a frame;

a first vertical calender assembly including a first calender roll supported by said frame for rotation about an axis and a second calender roll supported by said frame for rotation about a second axis, said first and second rolls being arranged to provide a first nip through which the web is adapted to pass to apply nip pressure on the web, said first vertical calender assembly including means for adjusting the position of one of said first and second rolls to control the nip pressure applied to the web, said means for adjusting the position of the one roll of said first and second rolls including a first movable carriage mounted on said frame for pivotable movement relative to said frame and carrying said one roll of said first and second calender rolls and including means for pivoting said first carriage;

a horizontal calender assembly including a third calender roll supported by said frame for rotation about a third axis, a fourth calender roll supported by said frame for rotation about a fourth axis, a fifth calender roll for rotation about a fifth axis, said third, fourth and fifth axes lying in a common plane, said third and fourth calender rolls defining therebetween a second nip through which the web is adapted to pass to apply a nip pressure to the web, said fourth and fifth rolls defining therebetween a third nip through which the web is adapted to pass to apply a nip pressure to the web, wherein the web is adapted to pass through said second and third nips without substantially wrapping the horizontal calender rolls, said horizontal calender assembly including a second movable carriage mounted on said frame for pivotable movement relative to said frame and carrying said third roll, means for pivoting said second carriage, a third movable carriage mounted on said frame for pivotable movement relative to said frame and carrying said fifth roll, and means for pivoting said third carriage; and a second vertical calender assembly including a sixth calender roll supported by said frame for rotation about a sixth axis, a seventh calender roll supported by said frame for rotation about a seventh axis, said sixth and seventh rolls being arranged to provide a fourth nip through which the web is adapted to pass to apply nip pressure on the web, said second vertical calender assembly including means for adjusting the position of said sixth roll to control the nip pressure applied to the web, said means for adjusting the position of said sixth roll including a fourth movable carriage mounted on said frame for pivotable movement relative to said frame, and including means for pivoting said fourth carriage.

12. Apparatus as set forth in claim 11, wherein said first and second rolls are supported so that the first and second axes of rotation define a substantially vertical plane.

13. Apparatus as set forth in claim 11 wherein said first carriage supports said first roll and is supported on the frame for movement about a pivot, and furthering including a loading cylinder to pivot said carriage.

14. Apparatus as set forth in claim 11 wherein said frame is formed as a one-piece structure.

15. Apparatus as set forth in claim 11 wherein said frame includes a base and a stanchion extending upwardly from said base.

16. Apparatus as set forth claim 15 wherein said stanchion includes an upper end, and wherein said frame also includes an upper platform which is supported by said upper end of said stanchion, said frame also including an intermediate platform which is located between said upper platform and said base.

17. Apparatus as set forth in claim 16 wherein said frame includes a thrust plate which extends in a cross-machine direction from the stanchion and which provides a pair of opposite facing, generally vertical surfaces respective facing upstream and downstream in a machine direction.

18. Apparatus as set forth in claim 17 wherein said stanchion has extending therethrough an opening in the cross-machine direction for providing access through the stanchion to the thrust plate.

19. Apparatus for treating a travelling web, said apparatus comprising a frame;

a first vertical calender assembly including a first pair of calender rolls supported by said frame for rotation about respective axes lying in a common plane, said first pair of rolls arranged to provide a first nip through which the web is adapted to pass to apply nip pressure on the web, said first vertical calender assembly including means for adjusting the position of one roll of said first pair of calender rolls to control the nip pressure applied to the web, said means for adjusting the position of the one roll of said first pair of rolls including a first movable carriage mounted on said frame for pivotable movement relative to said frame and carrying said one roll of said first pair of calender rolls and including means for pivoting said first carriage;

a horizontal calender assembly including a set of three calender rolls supported by said frame for rotation about respective axes lying in a common plane, said set of three calender rolls including a first roll and a second roll arranged to define a second nip through which the web is adapted to pass to apply a nip pressure to the web, said set of three calender rolls including a third roll defining with the first roll of said set of three rolls a third nip through which the web is adapted to pass to apply a nip pressure to the web, wherein the web is adapted to pass through said second and third nips without substantially wrapping the horizontal calender rolls, said horizontal calender assembly including a second movable carriage mounted on said frame for pivotable movement relative to said frame and carrying the second roll of the set of three rolls, means for pivoting said second carriage, including a third movable carriage mounted on said frame for pivotable movement relative to said frame and carrying said third roll of the set of three rolls, and means for pivoting said third carriage; and a second vertical calender assembly including a second pair of calender rolls supported by said frame for rotation about respective axes lying in a common plane, said second pair of rolls arranged to provide a fourth nip through which the web is adapted to pass to apply nip pressure on the web, said second vertical calender assembly including means for adjusting the position of one roll of said second pair of calender rolls to control the nip pressure applied to the web, said means for adjusting the position of the one roll of said second pair of rolls including a fourth movable carriage mounted on said frame for pivotable movement relative to said frame and carrying said one roll of said second pair of calender rolls and including means for pivoting said fourth carriage.

20. Apparatus as set forth in claim 19 wherein the web has opposed surfaces, wherein said first vertical calender assembly applies heat to one opposed surface of the web in said first nip, wherein said horizontal calender assembly applies heat to the other opposed surface of the web in said second nip and said third nip, and wherein said second vertical assembly applies heat to the one opposed surface of the web in said fourth nip.

21. Apparatus for treating a travelling web, said apparatus comprising a frame including a base and a stanchion extending upwardly from said base, said stanchion including an upper end, and wherein said frame also includes an upper platform which is supported by said upper end of said stanchion, said frame also including an intermediate platform which is located between said upper platform and said base, and wherein said frame includes a thrust plate which extends in a cross-machine direction from said stanchion and which provides a pair of opposite facing, generally vertical surfaces respectively facing upstream and downstream in a machine direction, and wherein said stanchion has extending therethrough an opening in the cross-machine direction for providing access through the stanchion to the thrust plate;

a first vertical calender assembly including a first calender roll supported by said frame for rotation about an axis and a second calender roll supported by said frame for rotation about a second axis, said first and second rolls being arranged to provide a first nip through which the web is adapted to pass to apply nip pressure on the web, said first vertical calender assembly including means for adjusting the position of one of said first and second rolls to control the nip pressure applied to the web, said means for adjusting the position of the one roll of said first and second rolls including a first movable carriage mounted on said frame for pivotable movement relative to said frame and carrying said one roll of said first and second calender rolls and including means for pivoting said first carriage;

a horizontal calender assembly including a third calender roll supported by said frame for rotation about a third axis, a fourth calender roll supported by said frame for rotation about a fourth axis, a fifth calender roll for rotation about a fifth axis, said third, fourth and fifth axes lying in a common plane, said third and fourth calender rolls defining therebetween a second nip through which the web is adapted to pass to apply a nip pressure to the web, said fourth and fifth rolls defining therebetween a third nip though which the web is adapted to pass to apply a nip pressure to the web, said horizontal calender assembly including a second movable carriage mounted on said frame for pivotable movement relative to said frame and carrying said third roll, means for pivoting said second carriage, a third movable carriage mounted on said frame for pivotable movement relative to said frame and carrying said fifth roll, and means for pivoting said third carriage; and a second vertical calender assembly including a sixth calender roll supported by said frame for rotation about a sixth axis, a seventh calender roll supported by said frame for rotation about a seventh axis, said sixth and seventh rolls being arranged to provide a fourth nip through which the web is adapted to pass to apply nip pressure on the web, said second vertical calender assembly including means for adjusting the position of said sixth roll to control the nip pressure applied to the web, said means for adjusting the position of said sixth roll including a fourth movable carriage mounted on said frame for pivotable movement relative to said frame, and including means for pivoting said fourth carriage.

22. Apparatus for treating a travelling web, said apparatus comprising a frame including a base and a stanchion extending upwardly from said base, said stanchion including an upper end, and wherein said frame also includes an upper platform which is supported by said upper end of said stanchion, said frame also including an intermediate platform which is located between said upper platform and said base, and wherein said frame includes a thrust plate which extends in a cross-machine direction from said stanchion and which provides a pair of opposite facing, generally vertical surfaces respectively facing upstream and downstream in a machine direction, and wherein said stanchion has extending therethrough an opening in the cross-machine direction for providing access through the stanchion to the thrust plate;

a first vertical calender assembly including a first pair of calender rolls supported by said frame for rotation about respective axes, said first pair of rolls arranged to provide a first nip through which the web is adapted to pass to apply nip pressure on the web, said first vertical calender assembly including means for adjusting the position of one roll of said first pair of calender rolls to control the nip pressure applied to the web;

a horizontal calender assembly including a set of horizontal calender rolls supported by said frame and including a first roll and a second roll arranged to define a second nip through which the web is adapted to pass to apply a nip pressure to the web, said horizontal calender assembly including means for moving one of the first and second rolls relative to the other roll; and a second vertical calender assembly including a second pair of calender rolls supported by said frame for rotation about respective axes, said second pair of rolls arranged to provide a fourth nip through which the web is adapted to pass to apply nip pressure on the web, said second vertical calender assembly including means for adjusting the position of one roll of said second pair of calender rolls to control the nip pressure applied to the web.

23. An apparatus for treating a travelling web, said apparatus comprising a frame;

a first vertical calender assembly including a first pair of calender rolls supported by said frame for rotation about respective axes lying in a first common plane, said first pair of rolls arranged to provide a first nip through which the web is adapted to pass to apply nip pressure on the web so as to treat a first side of the web;

a horizontal calender assembly including a set of horizontal calender rolls supported by said frame for rotation about respective axes lying in a second common plane including a first roll and a second roll arranged to define another nip through which the web is adapted to pass to apply nip pressure to the web to treat a second side of the web; and a second vertical calender assembly including a second pair of calender rolls supported by said frame for rotation about respective axes lying in a third common plane which is substantially parallel to said first common plane, said second pair of rolls arranged to provide yet another nip through which the web is adapted to pass to apply nip pressure on the web so as to treat said first side of the web.

24. An apparatus for treating a travelling web, said apparatus comprising a frame;

a first vertical calender assembly including a first calender roll supported by said frame for rotation about a first axis and a second calender roll supported by said frame for rotation about a second axis, said first and second rolls being arranged to provide a first nip through which the web is adapted to pass to apply nip pressure on the web, wherein the web is adapted to pass through said first nip without substantially wrapping said first and second rolls;

a horizontal calender assembly including a third calender roll supported by said frame for rotation about a third axis, a fourth calender roll supported by said frame for rotation about a fourth axis, a fifth calender roll for rotation about a fifth axis, said third and fourth calender rolls defining therebetween a second nip through which the web is adapted to pass to apply a nip pressure to the web, and said fourth and fifth rolls defining therebetween a third nip through which the web is adapted to pass to apply a nip pressure to the web, wherein said web is adapted to pass through said second and third nips without substantially wrapping said third, fourth and fifth rolls; and a second vertical calender assembly including a sixth calender roll supported by said frame for rotation about a sixth axis and a seventh calender roll supported by said frame for rotation about a seventh axis, said sixth and seventh rolls being arranged to provide a fourth nip through which the web is adapted to pass to apply nip pressure on the web, wherein the web is adapted to pass through said fourth nip without substantially wrapping said sixth and seventh rolls.

25. An apparatus for treating a travelling web, said apparatus comprising a frame having a base;

a first vertical calender assembly including a first pair of calender rolls supported by said frame for rotation about respective axes, said first pair of rolls arranged to provide a first nip through which the web is adapted to pass to apply nip pressure on the web, said first nip being located a first vertical distance from said base of said frame;

a horizontal calender assembly including a set of horizontal calender rolls arranged to define a second and a third nip through which the web is adapted to pass to apply a nip pressure to the web, wherein the web is adapted to pass through said second and third nips without substantially wrapping the horizontal calender rolls, said frame supporting said horizontal calender rolls in an elevated position generally above and downstream of said first vertical calender assembly; and a second vertical calender assembly including a second pair of calender rolls supported by said frame for rotation about respective axes, said first pair of rolls arranged to provide a fourth nip through which the web is adapted to pass to apply nip pressure on the web, said fourth nip being located a second vertical distance from said base of said frame, said second vertical distance being substantially the same as said first vertical distance such that the web enters and leaves said apparatus at approximately the same height with respect to said frame.

26. Apparatus for treating a travelling web, said apparatus comprising a frame;

a first vertical calender assembly including a first pair of calender rolls supported by said frame for rotation about respective axes lying in a common plane, said first pair of rolls arranged to provide a first nip through which the web is adapted to pass to apply nip pressure on the web, said first vertical calender assembly including means for adjusting the position of one roll of said first pair of calender rolls to control the nip pressure applied to the web, said means for adjusting the position of the one roll of said first pair of rolls including a first movable carriage mounted on said frame for pivotable movement relative to said frame and carrying said one roll of said first pair of calender rolls and including means for pivoting said first carriage;

a horizontal calender assembly including a set of three calender rolls supported by said frame for rotation about respective axes lying in a common plane, said set of three calender rolls including a first roll and a second roll arranged to define a second nip through which the web is adapted to pass to apply a nip pressure to the web, said set of three calender rolls including a third roll defining with the first roll of said set of three rolls a third nip through which the web is adapted to pass to apply a nip pressure to the web, said horizontal calender assembly including a second movable carriage mounted on said frame for pivotable movement relative to said frame and carrying the second roll of the set of three rolls, means for pivoting said second carriage, including a third movable carriage mounted on said frame for pivotable movement relative to said frame and carrying said third roll of the set of three rolls, and means for pivoting said third carriage;

a second vertical calender assembly including a second pair of calender rolls supported by said frame for rotation about respective axes lying in a common plane, said second pair of rolls arranged to provide a fourth nip through which the web is adapted to pass to apply nip pressure on the web, said second vertical calender assembly including means for adjusting the position of one roll of said second pair of calender rolls to control the nip pressure applied to the web, said means for adjusting the position of the one roll of said second pair of rolls including a fourth movable carriage mounted on said frame for pivotable movement relative to said frame and carrying said one roll of said second pair of calender rolls and including means for pivoting said fourth carriage; and wherein the web has opposed surfaces, wherein said first vertical calender assembly applies heat to one opposed surface of the web in said first nip, wherein said horizontal calender assembly applies heat to the other opposed surface of the web in said second nip and said third nip, and wherein said second vertical assembly applies heat to the one opposed surface of the web in said fourth nip.

27. Apparatus for treating a travelling web, said apparatus comprising a frame including a base and a stanchion extending upwardly from said base, said stanchion including an upper end, and wherein said frame also includes an upper platform which is supported by said upper end of said stanchion, said frame also including an intermediate platform which is located between said upper platform and said base;

a first vertical calender assembly including a first calender roll supported by said frame for rotation about an axis and a second calender roll supported by said frame for rotation about a second axis, said first and second rolls being arranged to provide a first nip through which the web is adapted to pass to apply nip pressure on the web, said first vertical calender assembly including means for adjusting the position of one of said first and second rolls to control the nip pressure applied to the web, said means for adjusting the position of the one roll of said first and second rolls including a first movable carriage mounted on said frame for pivotable movement relative to said frame and carrying said one roll of said first and second calender rolls and including means for pivoting said first carriage;

a horizontal calender assembly including a third calender roll supported by said frame for rotation about a third axis, a fourth calender roll supported by said frame for rotation about a fourth axis, a fifth calender roll for rotation about a fifth axis, said third, fourth and fifth axes lying in a common plane, said third and fourth calender rolls defining therebetween a second nip through which the web is adapted to pass to apply a nip pressure to the web, said fourth and fifth rolls defining therebetween a third nip through which the web is adapted to pass to apply a nip pressure to the web, said horizontal calender assembly including a second movable carriage mounted on said frame for pivotable movement relative to said frame and carrying said third roll, means for pivoting said second carriage, a third movable carriage mounted on said frame for pivotable movement relative to said frame and carrying said fifth roll, and means for pivoting said third carriage; and a second vertical calender assembly including a sixth calender roll supported by said frame for rotation about a sixth axis, a seventh calender roll supported by said frame for rotation about a seventh axis, said sixth and seventh rolls being arranged to provide a fourth nip through which the web is adapted to pass to apply nip pressure on the web, said second vertical calender assembly including means for adjusting the position of said sixth roll to control the nip pressure applied to the web, said means for adjusting the position of said sixth roll including a fourth movable carriage mounted on said frame for pivotable movement relative to said frame, and including means for pivoting said fourth carriage.

* * * * *